US005526743A

United States Patent [19]

Fadner

[11] Patent Number: 5,526,743

[45] Date of Patent: Jun. 18, 1996

[54] DAMPENING SYSTEMS FOR LITHOGRAPHIC PRINTING

[76] Inventor: Thomas A. Fadner, P.O. Box 3012, Oshkosh, Wis. 54903-3012

[21] Appl. No.: 302,519

[22] Filed: Sep. 8, 1994

Related U.S. Application Data

[63] Continuation-in-part of Ser. No. 61,736, May 17, 1993, abandoned.

[51] Int. Cl.[6] ..... B41L 23/02

[52] U.S. Cl. ..... 101/147; 101/350

[58] Field of Search ..... 101/147, 148, 101/349, 350

[56] References Cited

U.S. PATENT DOCUMENTS

| | | | |
|---|---|---|---|
| 4,278,467 | 7/1981 | Fadner . | |
| 4,461,208 | 7/1984 | Ghisalberti | 101/148 |
| 4,527,479 | 7/1985 | Dahlgren et al. . | |
| 4,690,055 | 9/1987 | Fadner et al. . | |
| 4,944,223 | 7/1990 | Ishii et al. | 101/148 |
| 5,107,762 | 4/1992 | Fadner et al. | 101/148 |
| 5,311,815 | 5/1994 | Ijichi | 101/350 |

OTHER PUBLICATIONS

Surface Chemistry Control in Lithography by Thomas A. Fadner Rockwell Graphics Systems, Cicero, Ill. dated Feb. 3, 1982, pp. 347–357.

Heidelberg M–Offset CP Tronic—Brochure pub. Sep. 1990 by Heidelberger Druckmaschinen Aktiengesellschaft.

Heidelberg Speedmaster CD CP Tronic—Brochure pub. Sep. 1990 by Heidelberger Druckmaschinen Aktiengesellschaft.

A Guide to Cardboard Printing—New Lithrone pub. Jul. 1991 by Komori Corporation, Tokyo, Japan.

*Primary Examiner*—Ren Yan

*Attorney, Agent, or Firm*—Morgan & Finnegan

[57] ABSTRACT

Apparatus and method are disclosed for lithographic printing whereby the dampening water input from a non-contact source is conveyed to the printing plate as an admixture in the ink by the inking train of rollers and adjuncts thereof having at least four inked roller nips between a dampening water input receiving roller and each inking form roller, the latter thereby also functioning as dampening form rollers.

6 Claims, 13 Drawing Sheets

DAMPENING SYSTEMS FOR LITHOGRAPHIC PRINTING

This is a continuation-in-part of application Ser. No. 08/061,73 filed on May 17, 1993 now abandoned

BACKGROUND OF THE INVENTION

1. Field of the Invention

This invention pertains to lithographic printing, and more particularly to dampening methods and apparatus associated with lithographic printing.

2. Description of the Prior Art

Conventional prior art dampening systems for lithographic printing presses are classed primarily as the continuous type or the semi-continuous ductor type, for which a dampening train of rollers makes direct physical contact with an initial dampening water input source on a full-time or part-time basis, respectively, and with a dampening form roller in contact with the lithographic printing plate. Certain recent dampening systems utilize a detached input of water by means of a spray or mist applied across a gap onto a receiving roller of the dampener train of rollers. Dampening systems with these detached or gapped water input means are termed discontinuous.

Other dampening systems such as the H. Dahlgren type in U.S. Pat. No. 4,527,479 and the Ghisalberti type in U.S. Pat. No. 4,461,208 use similar components to those just described but convey the dampening water to the plate by way of the first inking form roller instead of by means of a separate dampening form roller. In these indirect systems the first inking form roller actually becomes the dampening form roller. Special dampening water additives were found required for these systems to be acceptably operational.

In virtually all high-speed lithographic printing presses the dampening water is conveyed by means of a dampening train of rollers directly to the printing plate. By accumulating in the hydrophilic non-image regions of the plate, the water allows transfer of ink from the press inking form rollers only to the oleophilic image regions of the planographic lithographic printing plate. The resulting image differentiated inked regions of the plate are then transferred to a resilient blanket, then from the blanket to the substrate being printed.

In the practice of lithographic printing, nearly without exception, the dampening form roller is located prior to the first inking form roller and after the plate-to-blanket nip, as defined by the rotational direction of the printing plate. This practice is termed water-first dampening and the dominant prior art dampening configuration is termed the water-first, direct-to-plate, continuous type.

Dampening water conveyance to the plate by means of the inking train of rollers or by means of water-last, direct-to-plate dampening systems have been disclosed in the prior art and have been utilized in special types of lithographic presses, as, for instance, depicted in Fadner U.S. Pat. No. 4,690,055. These types have achieved limited commercial success and only in newspaper printing systems which have lower quality demands. Accordingly, both ink-train-dampening and water-last dampening have gradually been largely superseded in favor of conventional direct, water-first dampening systems and configurations.

The majority of installed high-volume lithographic printing presses around the world and virtually all of the high-volume lithographic presses currently being manufactured around the world utilize the dominant water-first, direct-to-plate continuous dampening configuration in one manifestation or another. All prior art dampening types suffer to a more or less significant degree from water interference with the transfer of ink to the printing plate. For instance, whenever the format to be printed contains low circumferential image content in one region of the plate at a given position of the overall press width and high circumferential image content in another cross-press location there exists no consistent prior art method, practice or apparatus to assure that dampening of the printing plate remains simultaneously trouble-free in both regions in regard to consistent and predictable ink input to the plate and thence to the substrate being printed. A similar situation occurs when changing from a low image content printing job to a high image content job or vice versa using the same printing press. A similar situation also occurs when switching from one ink type or source to another.

The inherent problems with these conventional dampening systems disallow consistent functioning of computerized inking systems. No known automated inking system can accurately be programmed for ink conveyance response to dampener-initiated printing system changes or disturbances because none of the prior art dampening methods can be accurately modeled to account for the disturbances. Even the most sophisticated computerized inking systems are not suitable for every printing condition because there exists no consistent prior art body of dampening technology that correctly allows or accounts for the influence of dampening upon the primary printing process function, which is inking.

This lack of dampening predictability is so pervasive that certain industry suppliers have developed waterless lithographic printing plates and presses in an attempt to obviate these ever-present dampening problems. Unfortunately, the waterless lithography approach requires exceptionally expensive inks, plates and presses. Also, waterless printing plates and presses are limited in the range of substrates that can be acceptably printed.

Fadner U.S. Pat. No. 5,107,762 depicts a lithographic printing process dampening system that utilizes initial dampening water input elements which are physically separated from a train of two or more direct-to-plate oleophilic and hydrophobic dampening water conveyance rollers, one roller of which is the dampening form roller contacting the printing plate. This dampening train of rollers becomes and remains partially inked during printing operations. The invention of the U.S. Pat. No. 5,107,762 patent was based solely on findings derived from keyless lithographic printing considerations. The disclosure therein is limited to the conventional direct-to-plate dampening configuration, which I have now discovered is not optimum for keyless lithographic printing and particularly not optimum for conventional keyed or zone inked lithographic printing systems. Currently, neither the 4,690,055 nor the 5,107,762 patent is being practiced or even tested using conventional key or zone inked lithographic presses. This is likely due to the preponderance of prior art lore and experience with zone or keyed printing presses that teaches against applicability of these patent technologies for conventional printing presses. I have now discovered that the technologies of these two patents are in fact not advantageously applicable to conventional lithographic presses.

The Dahlgren prior art dampening technology utilizes dampening water conveyance to the printing plate by direct roller contact of a dampening water input roller with the first inking form roller rather than by the more conventional means of an added dampening form roller contacting the plate. Having found that direct-to-plate dampening by means of an inking form roller was inoperable, Dahlgren uncovered that addition of rather large quantities of a water miscible organic liquid such as isopropyl alcohol to the dampening water remedied the practical problem that dampening water cannot be controllably carried directly to the printing plate by means of one or two inked rollers when one of the inked rollers is an inking form roller. In fact, the alcohol addition proved so useful in the practice of dampening that its incorporation pervaded the industry whether or not the dampener being used was of the Dahlgren type. This prior art background is summarized in Fadner U.S. Pat. No. 4,278,467, and the technical basis for alcohol's widespread acceptance is documented in "Surface Chemistry Control of Lithography." *Colloids and Surfaces in Reprographic Technologies*, by T. A. Fadner, ACS Symposium Series 200, pp. 348–57, M. Hair and M. D. Croucher, Ed., 1982.

Lithographic presses are easier to run and are more consistent, particularly as concerns ink/water interactions, when using 10 percent to 25 percent isopropanol in the dampening water. Substitutive additives for alcohol have by and large been unsuccessful in emulating this advantageous operational quality. In any case, all liquid organic material additives to the dampening water for this purpose are either highly or slightly volatile and are therefore environmentally and occupationally hazardous. The need remains to meet the advantageous operating influences of alcohol without necessity for use of any volatile organic compounds.

It is well known that to carry out conventional lithographic printing practices, two liquids are required, relatively viscous ink and relatively fluid dampening water. The viscous lithographic ink is essentially a non-volatile liquid insofar as the printing process is concerned. Consequently, excepting for mechanical losses, every bit of ink that is input to the press system is output by the press in the correct positions and amounts onto the substrate being printed. Conversely, water is an evaporative liquid under the pressroom operating conditions of temperature, pressure and room ventilation. Water will vaporize from and as vapor will generally move away from every operating press component upon which it is located.

It is also well known that lithographic ink can and must accept and tolerate some water within its continuous liquid film phase on press during lithographic printing operations. Water-proof inks are inoperable in the lithographic process and conventional lithographic printing is then not possible. Since all press rollers are manufactured to convey either water or ink, all roller and cylinder surfaces, whether hydrophobic or hydrophilic and whether or not ink covered will carry uppermost, normally molecularly thin, liquid/vapor water surface layers during printing operations. Water as vapor will be continually lost by evaporation away from all of these surfaces. In addition, liquid water will be lost by being printed out as part of the intended image of ink. Because of these natural and unavoidable water vapor and liquid water loss paths, considerably more dampening water must be input to a lithographic press system than would be required merely to replenish the natural water losses from only the printing plate non-image areas, which areas are the only locations where films of liquid water are appropriate on a continual basis while printing.

Water can and must enter the ink phase, and it is this interaction between water and ink that constitutes both the efficacy of lithography and the bane of lithography, the latter in terms of adverse effects of mechanically imposed or forced interactions related to press designs.

To achieve optimum lithographic efficiency relative to ink/water interactions, the press system must reach a water input-output equilibrium operating condition or steady-state appropriate for the speed, operating temperature, input rates of consumable ink and dampening water materials being used, and for the quality parameters of the product being manufactured. A slightly higher rate of dampening water input to the press than the equilibrium value will cause accumulation of additional water in the ink films residing on the various rollers, on the plate, and on the blanket. This system response must occur because water cannot evaporate faster from the various press components than the already established equilibrium rate, which is a natural response to ambient pressroom and press operating conditions. Consequently, under any water input rate condition just greater than this naturally occurring loss rate, the slightly excess water will be carried to the substrate by way of the ink being printed onto the substrate, and perhaps also by way of the non-image areas of press components that contact the substrate. The substrate path is the only natural path left for extra or excess water to exit the press system without noticeably adverse printed or operational quality disturbances.

When the dampening water input rate is further increased, a point is reached at which the thin ink films on the rollers cannot assimilate all of the increased water input. Free water may appear as more or less extended films on inked surfaces or at inked nips. A free water film can interfere directly with the intended smooth transfer of ink to the printing plate image areas and then to the substrate. This higher rate of water input is commonly referred to in the trade as exceeding the upper limit of ink/water balance latitude. The lower limit of ink/water balance latitude is, of course, the dampening water input rate which just fills all of the water loss paths of the press system. Below that rate of dampening water input, the inking form rollers will remove water from the printing plate non-image areas in order to fill the various inking rollers' surface evaporative demands, which loss paths had become water-starved under the low water input condition. When insufficient water remains in the non-image areas of the plate to prevent transfer of ink from the inking form rollers, the operating condition is termed toning or sometimes termed tinting. Ink will then reach the plate and therefore the substrate in areas corresponding to non-image regions that were supposed to remain unprinted and ink-free. All of the prior art conventional direct-to-plate dampening systems exhibit these water input faults to varying degrees. All of these prior systems in the absence of an alcohol additive are particularly sensitive operationally, having a narrow ink/water balance latitude range. With input efficiency faults of this kind, critical formats cannot be routinely printed at acceptable quality levels. Inking control systems cannot function as desired by design, trouble free.

To counter inefficient dampening water delivery to non-image areas of the plate, it is common printing practice for an operator to increase the dampening water input rate. Under this condition, water is lost not only to the natural printed out and evaporative paths but also by slinging and or misting loss of liquid water drops from the operating press components. When this occurs, product quality deterioration is usually observed because more water than lithographically necessary for image differentiation at the plate is being forced onto the press components and towards the plate and towards the substrate, all of which are adverse conditions. The press system may seem at times to be at a steady operating condition and acceptable printed quality is achieved momentarily because much of the detrimental excess water is slinging off from press components rather than interfering with the printing operation. However the system will vacillate out of and into acceptable printed output, requiring undue operator attention to fluid input rates and other mechanically controllable factors. There remains need for a press system that will function at the minimally required water input rates under all printing conditions thereby avoiding this very common continual operator adjustment paradox.

Any dampening water conveyance method or system that places a continuous or even a discontinuous but finite film of liquid water onto any roller that must transfer ink, particularly inking form rollers that contact the printing plate, are inherently inefficient dampening systems because the dampening system interferes with the primary function of the press, delivering ink to the plate. Relative to the ink's ability to imbibe or to pick up water at a nip with another roller, the natural water vapor film associated with press components can readily be exchanged to or from either or both rollers. The natural evaporative quantity of water vapor at a roller's surface does not constitute a barrier to transfer of either or both the ink or water from one roller to the next at their mutual nip. However, any liquid water film, no matter how thin, represents excess water most of which cannot be transferred into an ink film at a nip rapidly enough to disappear. Accordingly, any liquid water film represents a barrier to ink transfer. In fact, that is how lithography functions; by maintaining a finite thin film of liquid water in the non-image areas of the printing plate, allowing normal ink transfer only to the image regions of the plate. Whenever a finite film of liquid water appears between two inked surfaces more water than desired has been input to that nip. There will be poor ink/water balance latitude, poor operational control.

The ink/water balance latitude factor for a given lithographic press operating at a true lithographic equilibrium is therefore dictated in part by the ink's inherent ability to assimilate and distribute water towards all of the natural water loss paths. This dampening water distribution must be accomplished without significant change to nor interference with any of the critical quality properties of the ink. It is the intention of the present technology to do so.

As conventionally taught, lithographic printing problems are said to be dependent upon whether the printing plate is being overdampened or underdampened. While correct, this prior art statement is incomplete. It will become apparent in the present disclosure that optimum trouble-free dampening requires that none of the inking or dampening roller surfaces, as well as the printing plate surfaces, anywhere in the press system be overdampened or underdampened at any time during printing operations. The whole press inking system must be maintained at a steady operating state relative to the dampening water input rate. It will also become apparent that optimal lithographic dampening is coincident with minimal practical rate of dampening water input and therefore is automatically coincident with minimal number, variety and severity of the adverse ink/water interactions characteristic of prior art dampening systems.

Virtually all of the prior art dampening systems, which are of the direct-to-plate water-first type, are designed and tested to convey a continuous film of dampening water or dampening water solution towards the printing plate. The primary manifestation of this fact is the nearly universal practice of having a hydrophilic roller in the dampening input roller set to assure formation of a continuous water film thereon for subsequent direct conveyance to the plate by means of a dampening form roller. This practice renders the first inking form roller subsequent to the dampening form roller totally or at least largely incapacitated as an inking form roller. This readily demonstrated adverse condition follows logically from the fact that the first inking form roller subsequent in the printing plate rotational direction to the predominantly practiced water-first-dampening form roller configuration encounters at its nip with the printing plate a film of liquid dampening water that had to be input at a rate equivalent at least to the loss rate from all of the natural water loss paths, most of which are upstream in direction relative to the ink input, and not at a rate equal only to water losses from the plate. The dampening water input rates required for these systems is far greater than that which would be required merely to replace water losses from only the lithographically critical component, the printing plate. This required rate of dampening water input being forced in the prior art directly onto the printing plate is also greater than that which can readily be assimilated by the thin film of ink residing on the first inking form roller, merely by passing through its single, low-residence-time, narrow-nip with the printing plate. The reality of this condition is substantiated by the well known and demonstrable fact that when water-last direct-to-plate dampening is attempted, for which the dampening form roller is placed subsequent to the last inking form roller and therefore rotationally prior to the plate/blanket nip, transfer of ink from the plate to the blanket is completely lost or at best is nearly uncontrollable because of the water film forced onto the inked image areas on the plate by the water-last dampening system.

Since the ink film on the first inking form roller of, for instance, a set of four inking form rollers, cannot continuously carry away from the plate surface sufficient of the excess water input from the dampener, the second inking form roller may be affected similarly though less extensively. Perhaps also the third form roller. Each successive form roller is subjected to less excess water due to portions of the excess water having already been transferred by preceding form rollers towards the inking train of rollers water vapor loss paths. Finally, at the fourth or perhaps at the third inking form roller the water input to and from those rollers will closely approximate a natural water flow loss path equilibrium condition. One or both of the last inking form rollers will then be able to function properly and predictably as ink delivery rollers with little or no adverse interference from nor presence of liquid dampening water films on top of the ink that resides on the plate and on the contiguous rollers despite the excess dampening water initially input towards the printing plate.

Isopropyl alcohol assists the process of filling all the evaporative loss paths by rendering more efficient liquid water movement into and out of ink films. Thus, excess water, when present, is more readily removed from for instance the plate image areas by the inking form rollers, making the third and fourth, perhaps even the second form roller correspondingly more efficient in their intended roles as inking rollers. Under this condition of less liquid water interference with inking, a conventionally dampened press operates with less attention required to dampener related faults than without the alcohol additive. These factors explain the recent past virtual overall dependence on this additive that occurred over much of the industry.

When using for demonstration purposes a multiple inking form roller printing press carrying a printing format not subject to mechanical ghosting that normally could occur because of differing inking form rollers and plate cylinder diameters, it can be demonstrated that the printed ink density decreases markedly as the number of inking form rollers being employed is decreased, other factors being held constant. It is also well known that the last inking form roller, the one farthest from a conventional, direct, water-first dampening form roller, delivers during normal operation the smoothest and most water-interference-free ink film of the inking form roller set.

These observable factors using prior art practices are in part dampening design-related and secondarily inker-design related. Less than optimal inking conditions are the result of the inherently inefficient direct-to-plate conventional dampening practices which partially to severely negate what would otherwise be efficient conveyance of ink to the printing plate by all of the press system's inking form rollers. The excess rate of water input using these prior art conventional dampening systems coincides with the presence of one or more free liquid water films at the plate/inking form rollers' nips both in the image and the non-image regions of the plate.

The oleophilic and hydrophobic dampener roller system of U.S. Pat. No. 5,107,762 is advantageously functional for keyless inking lithographic systems. In keyless inking systems both the ink and the water inputs are continuously uniform across the press width. In conventional systems only the latter is input uniformly. In a keyless system, that portion of the ink not used by the plate, and coincidentally any water that has been mulled into the ink, is continuously scraped off the return side of an inking roller for reuse by the keyless press system. However, the dampener means of the U.S. Pat. No. 5,107,762 patent is not optimal nor perhaps even useful as the dampener input means for conventional zoned ink input printing presses wherein all of the ink being input must of necessity be printed out.

In practice, the oleophilic and hydrophobic dampening rollers of the U.S. Pat. No. 5,107,762 patent, being directly in liquid transfer contact with the plate, become ink covered only in circumferential bands located at cross-press positions directly corresponding to the cross-press locations of images on the printing plate. The greater the circumferential image content at any given cross-press location, the more complete is the corresponding circumferential ink film band observed on the dampener rollers, that is, the more likely that specific region will carry the maximum amount of ink possible, namely, that carried on average by the inking form rollers. Obviously, it is only these bands of ink on the dampener rollers that can participate in causing dampening water to mix into the ink for its non-interfering conveyance to the plate and this can occur only for the correspondingly located cross-press portions of the dampening water input which is being applied uniformly across the press width. Only these specific inked regions of the dampening rollers of the U.S. Pat. No. 5,107,762 patent can participate in what is termed in the present disclosure an admixture conveyance of dampening water and ink to the plate. Since normal overall image content varies up to about 50 percent coverage for most printing jobs, most of the U.S. Pat. No. 5,107,762 dampening roller surface area will not carry ink. The primarily uninked portions of the dampening system of the U.S. Pat. No. 5,107,762 patent operate exactly like a conventional direct-to-plate, non-inked dampening system with its inherent excess-water-induced interference with ink transfer. This adverse condition will be particularly severe with low image content formats, especially if attempts are made to utilize the U.S. Pat. No. 5,107,762 technology with conventional zoned inking presses where none of the input ink or water is being continuously removed as in keyless inking.

Prior art examples of attempts to obviate these pervasive dampening water interference problems in conventional presses include, for instance, the Alcolor Dampening system marketed by Heidelberger Druchmaschinen Aktiengesellschaft of Germany. A roller diagram reproduced from Heidelberg's April 1990 brochure titled *M-Offset CP Tronic* is illustrated together with the press inking rollers as FIG. 1. Dampening system 10 utilizes a differential speed nip 11 to meter a thin dampening liquid water film onto hydrophilic roller 12 which dampening water is then transferred in whole or in part as a liquid film to dampening form roller 13 thence to the printing plate mounted on cylinder 14. As in any printing press, the inking form and dampening form rollers must be covered with rubber or similar viscoelastic material because of mechanical and material considerations of their contact with the hard-surfaced printing plate. Rubber is naturally oleophilic and hydrophobic, therefore all form rollers on any press such as roller 13 in contact with an inked plate will normally tend to carry some ink. Ink will appear in differential cross-press regional amounts corresponding to image locations as just previously described herein for the U.S. Pat. No. 5,107,762 patent technology. Hydrophilic roller 15 is described to impart additional metering and/or smoothing action to the purposefully liquid, thin water film extending around and across roller 13. Oleophilic and hydrophobic copper roller 16 is somewhat unique for this otherwise conventional prior art dampening system in that it allows an inked roller bridge between form roller 13 and the inking system of rollers 16A by means of nip contact 17 with inking form roller 19. To the extent that ink transfers from roller 19 to roller 13 by means of roller 16, these may nearly operate as overall inked rollers in this particular system. Nevertheless, dampening form roller 13 must of necessity carry a more-or-less continuous water film on its surface.

This Alcolor bridge variation of the conventional, water-first, direct-to-press dampening method is consistent with my discovery of the inherent lithographic printing need that the water be purposefully mulled into the ink. However, the use of only one fully inked roller nip 17 between the water input source hydrophilic roller 12, and the first inking form roller 19 is far from sufficient to mull all of the input water into the ink even assuming that the relatively small volumes of ink on these rollers could accommodate all of the input ink required to fill all of the subsequent press component water loss paths without interfering with ink transfer. Consequently, but perhaps less severely than with non-bridged counterparts, the Alcolor system encounters all of the typically adverse lithographic water interference problems with inking that have already been described herein.

Other Heidelberg literature is consistent with this and other explanations herein. The manufacturer has modified the design of the inking train of rollers to automatically place considerably more ink on the first two inking form rollers than on the last two. Apparently, the combination of the Alcolor dampener and the extra ink input to the two form rollers that are exposed by the dampener to the greatest ink transfer water interference problems was found to improve press operations, particularly when inking has been computer automated (Heidelberg Speedmaster CD, CP Tronic, distributed publicly April 1993).

The Koromatic Dampener system marketed by Komori Corporation of Japan and illustrated in their July 1991 brochure titled *New Lithrone* is reproduced for use on their sheet-fed presses as FIG. 2. This direct-to-plate, continuous, water-first dampening system 20 utilizes a reverse slip nip 21 to meter a thin liquid water film onto the rubber dampening form roller 22 for subsequent transfer to the printing plate mounted on cylinder 23. This system employs an oleophilic copper roller 24 riding on rubber form roller 22, but unlike the Heidelberg system of FIG. 1, the Komori copper roller 24 does not bridge with inking system 25. As with the FIG. 1 system, a hydrophilic chrome roller 26 is required to prevent ink feeding back to water fountain 27 because of the direct connection between rollers 22, 26, 29, and 28 and is utilized to form a thin film of liquid water for transfer to the plate. If copper roller 24 is oscillated, the small amount of ink picked up by rubber dampening form roller 22 will be spread out somewhat, thereby nearly approximating the Heidelberg bridged roller advantage. However, typical prior art dampening interference with inking does and will persist for reasons already presented.

One prior art disclosure wherein the dampening water is conveyed indirectly to the plate by way of certain inking rollers and primarily by way of the first form roller, rather than totally or primarily by means of a direct-to-plate device typical of conventional prior art just described, is that of Ghisalberti in U.S. Pat. No. 4,461,208. This Ghisalberti technology is a variation of the Dahlgren technology already discussed herein and has the same faults and limitations.

As shown in FIG. 3, Ghisalberti utilizes chrome roller 5A to present a more or less uniform liquid dampening water film thereon for transfer in whole or in part as a liquid film to metering roller 6A which roller's surface composition is not specified. The latter may be assumed to be rubber, therefore oleophilic, because it must contact two hard-surfaced rollers, namely chrome roller 5A and inking transfer roller 7A of inking roller system 110. During operation, roller 6A will become mostly liquid water film covered because of its function as a dampening water distributing roller, despite the fact that it might also carry an ink layer beneath the water film that had been distributed to it in an upstream manner from inked transfer roller 7A. The transferred film of dampening water is reportedly milled into the ink during its transfer delivery by the inking system rollers to the plate by means of nips 111, 112 and 113 made with the inking distribution roller 7A and form rollers 8A and 9A. Obviously, milling, mixing action between water and ink at the plate/form roller nips would be counterproductive to image differentiation. Consequently, the form roller/plate nips cannot be considered primarily as water- into-ink-milling nips. Thus, this configuration provides at best two roller nips 111 and 112 that carry ink between the dampening water source roller 6A and the first ink form roller 8A and three such nips 111, 112 and 113 to form roller 9A.

The structure of the Ghisalberti technology does not recognize that a steady state water content must be achieved at all of the operating inking rollers of inking system 110 as well as at the plate 114 itself, as disclosed and discussed elsewhere herein. The FIG. 3 and related Ghisalberti reference drawings place the dampening water input at a press location where much of the input water must be conveyed upstream from the input roller 6A and from inking form roller 8A, in a direction away from the plate where the water is primarily required, while the ink is being conveyed downstream towards the plate, in order to fill the water vapor loss paths associated with all of the rollers between transfer roller 7A and form rollers 10A and 11A. Consequently, as with water-first dampening, more dampening water than minimally necessary for image differentiation at the plate must be continuously input to and be carried by the thin ink film on roller 7A, therefore also by that on rollers 8A and 9A. Water interference problems are to be expected similar to those encountered with Dahlgren dampening structures particularly in the absence of alcohol, as with the Heidelberg and Koromatic examples and the like already discussed herein. This prediction is verified accurate by the fact that Ghisalberti technology is not operational as just described. It requires and is limited by the patentee to the conditional use of the relatively large volumes of isopropyl alcohol in the dampening water, namely about 10% to 30% or more to be operational, as also required by the Dahlgren indirect to plate system herein previously discussed.

Graphic Systems Division of Rockwell International Corporation, a domestic company, marketed lithographic presses to newspaper printers which included what were termed ink train dampening systems (ITD) shown schematically in FIG. 4. This unpatented dampening configuration was prompted by customer demand that dampening components be readily accessible on the indicated side of the inking train of rollers for cleaning and maintenance. The dampening system 30 has a separated brush spray water input 31 which system is easy to clean. Input is to an inked roller 32 riding on a first copper inking drum 33 of the inking system 34. This system functioned reasonably well but there are at best only two or three nips carrying both ink and water between the receiving roller 32 and the inking form rollers in contact with the plate, as indicated numerically in FIG. 4, to mull water into the ink on its way to the plate. Also, the ink films on rollers 32 and 33 which need to convey all of the dampening water input are relatively thin, as in the Ghisalberti case, hardly capable of continuously handling all of the water that needs to be input to the press system. Although water input is primarily and advantageously in the ink downstream direction of travel towards the plate, field experience relative to increased demand for improved printed quality due to adverse ink/water interactions prompted gradual withdrawal of this system in favor of the more effective conventional direct-to-plate dampening systems.

There remains need for a consistent, repeatable, predictable, and efficient means for conveying to a lithographic plate the water required to maintain image differentiation at the plate without introducing significant adverse influence of the dampening water on the delivery of ink to the image area of the plate.

SUMMARY OF INVENTION

In accordance with the present invention, a method and apparatus for assuring continuous optimal input of dampening water to any lithographic printing press are provided that are independent of printing plate format, of practical printing speed, and of ambient operating conditions.

The method and apparatus of my invention utilize the concept that dampening water as a necessary but evaporative lithographic printing operations material can and will escape by evaporation from every print operational surface of the press system during printing. This roller surface evaporative loss of water plus an additional amount lost as part of the ink film image printed onto the substrate account for all of the input water required to operate lithographically. Prior art systems must input additional water more or less directly to the plate under all operating conditions. It is technically correct for all cases of efficient lithographic operations, as hereinafter defined, that the rates per unit area of water evaporation from every press roller surface whether inked or not and from the surface of the substrate being printed are for practical purposes identical. This logical factor greatly simplifies understanding the basic concepts of my invention.

With these principles as the basis, I have determined that four criteria must be satisfied to achieve the lithographically most efficient operation condition:

1. The means for initial input of dampening water to the press system is preferably separated from the press rollers, to help disallow formation of liquid dampening water films on any press component and to provide means for controllably uniform input of finely divided droplets or mist of dampening water.

2. As with all operable conventional lithographic inks, the ink used in the practice of this invention must be able to assimilate some dampening water as hereinafter defined.
3. No component of the dampening system should allow, cause or force a significantly higher rate of dampening water conveyance to any critical inking component of the press system than the rate required for replacing the natural water evaporative path losses plus any printed out losses associated with natural water transport to or by means of that component.
4. The dampening water should be conveyed to the printing plate as an admixture within the continuous phase ink film by a sequence of rollers which provide four or more nips for admixture formation and transfer primarily and preferably in the downstream inking direction from the dampening water input means of Criterion 1 towards each of the inking form rollers.

By means of the present invention, the inking train of rollers is used to mull or mix dampening water to form an admixture within the ink that is being conveyed to the printing plate. The inking form rollers thereby function both for ink input and dampening water input to the plate as hereinafter explained.

These criteria are readily met by means of my present invention. Only when operating within these criteria can the condition of minimum dampening water input required for image differentiation at the plate be achieved and maintained using any lithographic press system. Meeting these criteria allows optimum latitude in low to high image content operability with the attendant improvements in operation and in consistently higher printed product quality.

Meeting the indicated criteria allows minimal operator attention to dampener input settings because the press always operates at essentially the same input conditions insofar as dampening is concerned. In addition, the absence of need for severe dampening input changes because of differing formats allows predictable control by automated press inking systems. The control system variables are no longer adversely influenced by spurious and unpredictable dampening-related operational changes or differences.

It is advantageous to input dampening water as a mist or spray of fine droplets to a selected press roller component, the finer the droplet size the better, within practical controllability factors. This accomplishes two important conditions. First, the dampening water is input to the press in a condition readily utilized by the ink, compared with its being input in liquid film form. Water cannot mix into ink as a finite liquid film, even if both the ink and water are in the form of thin films. Liquid water can enter an ink film when gently forced to do so, such as at a roller nip, only if it is first broken up into relatively small droplets or clusters of water molecules of small rapidly diffusable dimensions. In the present invention, the initial work of breaking up the dampening water into relatively small dimensions is accomplished before the water reaches any press component. In the prior art, the input of a finite thin liquid film of dampening water to a press component requires that component and subsequent rollers must do the work of breaking up the liquid film into sufficiently fine particles such that water can readily be assimilated by the ink. It requires from one to three additional and sequential nips carrying ink to achieve the droplet dimensions similar to that of spray input systems.

Secondly, input of a spray or mist of water to a selected press component requires providing a gap between the spray device and the selected press component. The gap functions to disallow feedback of ink into and towards the input dampening water device. All prior art contact type dampening systems in which a set of rollers conveys dampening water from for instance a pan source to the first dampening roller that is in contact with a press component are subject to feedback contamination of ink towards and into the dampening water source. Consequently, most prior art dampening devices must employ a hydrophilic roller, usually chrome coated, somewhere between the source pan and the first press component in order to isolate the former component against feedback from the latter. However, the use of a hydrophilic roller results in an overall film of liquid dampening water being formed on that roller because of the hydrophilic preference for water in the presence of ink. The water film on the chrome roller is how the feedback isolation is accomplished. In the absence of water, a chrome roller will carry ink.

As previously explained herein, despite its widespread use, a chrome roller anywhere in prior art lithographic dampening systems is counterproductive to efficient dampening water input. A film of liquid water rather than water droplets or clusters is thereby conveyed to the subsequent rollers and towards inking form rollers of the press.

A water assimilation capability by the ink of at least about five percent by volume will generally suffice to meet Criterion 2. The ink should also have an upper limiting value of water assimilation capability which in the industry conventionally is in the range of about 20 percent to 40 percent by volume of the resulting mixture. The water take-up test termed the Surlyn Test utilizing, for instance, a Duke Custom Systems apparatus, will suffice to establish these test values. These are normal and conventional values for lithographic inks.

It is well known, particularly by ink manufacturers, that dampening water can readily enter and leave typical lithographic inks at a nip formed by two rollers carrying ink that are in rotational fluid transfer contact depending upon the circumstances at the nip. Water droplets or clusters placed on either or both rollers prior to the nip entrance become totally or in part mulled within the nip into the ink films on the two rollers. If the ink on one or both rollers is low in water content relative to demand for water conveyance towards subsequent evaporative paths, such as by means of a second sequence of contacting inking rollers, the mulled water clusters will tend to remain within the ink film as an admixture upon emergence from the nip and be conveyed and transferred within the ink film by means of the subsequent roller nips towards the unfilled natural water loss paths.

If the ink at one or both of the original rollers' mutual nip is already saturated with water relative to subsequent water loss path demands, surface water droplets placed on either ink film near the nip entrance and temporarily mulled into the ink at the nip cannot be retained by the emerging ink films and correspondingly one or both roller ink films will emerge from the nip with droplets or clusters or even finite thin liquid films of water on the inked surfaces. This condition may result in interference with ink transfer at this or subsequent nips.

The thicker an ink film on a roller being considered, the more readily the ink film on that roller can function as a reservoir for subsequent multiple path distribution of the dampening water which for any press system must necessarily be input at a rate somewhat greater than that required to only replace the amount of dampening water lost by evaporation directly from that roller. It should also be noted that the average water droplet dimension of practical dampening water spray input devices is larger than the ink film thickness dimension of about 2 to 8 microns at or near the plate and about 8 to 30 microns on rollers upstream from the plate nearer to the ink input source. Also, by comparison, even a thin liquid water film is essentially infinite in its lateral dimensions. To avoid water interference, the dampening input system and inking roller system must disallow conveyance of finite dimensioned water films onto any surface. It follows that at any given inking roller there must be at worst only a small percentage of dampening water droplets or clusters with dimensions exceeding the ink film thickness dimension at the roller under consideration. Otherwise, a considerable portion of the input water cannot possibly be contained within the ink film to avoid water interference with ink transfer. The incoming dampening water must be worked, that is divided, into smaller and smaller particles by the system rollers to about the same extent as the ink, which also is purposefully being worked by inking rollers into thinner and thinner films on its way to the plate. To accomplish this, I have found that the use of at least four roller nips between an ink receptive dampening water input roller and each of the inking form rollers of a press are required and that this requires providing that the initial water input is in a liquid droplet or mist form, not in a liquid water film form. More roller nips will be required if the dampening water is presented to or forced onto a first dampening water roller as a liquid film. In the absence of the input location principles herein, correspondingly more water interference problems will persist.

Whenever one of the two rollers at their mutual nip is hydrophilic in whole or part, such as the water-layered non-image areas of a lithographic printing plate, water clusters within a water-in-ink admixture under nip pressure are temporarily capable of entering or leaving the ink admixture, can diffuse out of the admixture and be transferred to the receptive hydrophilic non-image regions of the plate. As the same admixture-covered inking roller, termed a form roller, contacts the oleophilic image areas of the plate, some of the predominantly ink admixture transfers to those areas thereby replenishing the ink required for subsequent print out to the substrate. In this manner continuous lithographic image differentiation and ink replenishment is accomplished without the pervasive prior art necessity for handling problem-laden liquid dampening water input films.

Providing that Criteria 1 and 2 are met, Criterion 3 may be satisfied primarily by proper selection of the configurational position of the press system at which the dampening water is introduced. This criterion is one of the new and novel elements of the present invention and its efficacy will be illustrated subsequently in this disclosure.

Criterion 4 is another new and novel element of this invention, particularly when considered in conjunction with Criterion 3. The only prior art involving inked rollers to deliver dampening solution are the ink-train-dampening, the single-inked-roller water-first direct-to-plate dampening roller technologies previously cited herein, and the Dahlgren and Ghisalberti indirect-to-inking-form-roller systems also previously discussed herein. Each of the former prior art technologies has either or all of an inadequate number of rollers, an inefficient configuration of inked rollers, or an incorrect or inefficient location of the dampening roller input roller to achieve all of the Criteria 1 through 4 disclosed herein.

Criteria 3 and 4 focus on solving the crux of the prior dampening system problems and form the primary novel basis for the printing and dampening systems disclosed herein. The dampening system of U.S. Pat. No. 5,107,762 meets certain of the criteria herein previously set down for the present invention, namely Criteria 1 and 2. However, Criteria 3 and 4 cannot be satisfied merely by using oleophilic and hydrophobic rollers due to the excess water input required when using the direct-to-plate dampening configuration called for in that reference, despite the possibility that under very high overall ink coverage conditions the rollers could become ink covered.

In view of the principles set forth in this disclosure, the inadequate ink-train dampening system of the Graphic Systems Division of Rockwell International Corporation can be used to illustrate the necessity for meeting Criterion 3 set forth earlier herein. All of the water required to continuously fill all of the water evaporation paths is input by the FIG. 4 system into the nip between main inking roller 33 and dampening roller 32 which has a relatively thin ink film therein. Forcing more water into the ink at that nip than the amount required as makeup for all of the inking system water loss paths tends to prevent roller 33 and therefore inking form roller 36 from smoothly conveying and transferring ink to the plate. An actual film of water appears at that nip. The corresponding printed faults cause pressmen to increase ink feed in order to maintain printed optical density, which in turn necessitates even greater water input to avoid toning. The attendant operating fault is unacceptable. Excess ink and excess water accumulate at and would sling off from press components near the ink input system 37. In these systems, dampening solution is applied to the press at an inefficient location relative to the inking form rollers and the printing plate, and an insufficient number of roller nips carrying ink are employed to enable complete and efficient formation of a useable water-in-ink admixture.

As noted previously in Criterion 4 of this disclosure, optimal lithographic dampening requires that no critical component of the press inking system be forced to receive, convey, or handle significantly more water than is required to replenish the natural water loss paths associated with that component of the press system. An important corollary of this requirement is that no critical inking portion of the press be required to receive, convey or handle any free water whether in the form of an overall continuous film or discontinuous films of finite dimensions. The best way meet this critical water requirement is to mull incoming preformed water droplets into the ink to form a semi-stable two-phase fluid admixture or microemulsion of minute discontinuous water droplets or clusters within the continuous phase ink film. The dampening water as the discontinuous phase exists as extremely small forcibly-mobile clusters of water. The ink as a viscous continuous phase allows retention of discontinuous water clusters within its continuous phase and as the continuous phase causes the admixture to behave like ink despite the presence of water therein. Water retention allowance of the admixture can be moderated for instance by means of shear or liner pressure. Simple pressure at any of the roller nips containing the admixture makes both the water clusters and the continuous ink phase admixture available at the nip for transfer to and form hydrophilic or oleophilic surface or to water or to ink films on the two rollers involved, as previously described herein.

Accomplishing sufficient mulling action to form a water ink admixture that functions as just described requires that the dampening water be conveyed to the plate by means of a sufficient number of inked rollers, namely a sequence of rollers containing at least four nips of rollers capable of carrying ink not counting the form roller to plate nips. It also requires that the dampening water be input to a selected roller of the inking train of rollers, so that dampening water being carried within the subsequently formed ink admixture carried on the inking rollers will fill the inking train water vapor loss paths while the admixture is being conveyed to the plate. In nearly all of the prior art, the inking train loss paths must be filled in sequence with dampening water that was first delivered to the plate because of the position of the dampening water input system. This is why prior art systems must input excess water to the plate.

By means of the present invention, dampening water is always input to a selected press inking roller located sufficiently upstream in the ink conveyance direction from the printing plate that the ink film thickness associated with the selected press inking roller is large compared with the ink films on rollers located near the plate. This larger ink film volume can more readily act as a reservoir for conveyance of dampening water by the downstream contiguous inking rollers to the plate.

A logical and systematic method to evaluate which of all possible dampening alternatives is best and most efficient for any given lithographic printing press inking configuration can be employed as disclosed herein. This method leads directly to the basis for my invention. The concepts presented here can be quantified and modeled when appropriate experiential data is collected but as herein disclosed there exists no essential need to do so. The practice of my invention renders dampening a trivial factor relative to optimal maintenance of the operational and printed qualities traditionally expected but heretofore seldom achieved from the practice of conveying ink to a lithographic printing plate.

Meeting the need for a consistent, repeatable, predictable, and efficient means for conveying to a lithographic plate the water required to maintain image differentiation at the plate without introducing significant adverse influence of the dampening water on the delivery of ink to the image area of the plate is a primary objective of this invention.

It is another objective to provide method and apparatus whereby the minimum required water input to any lithographic press can be achieved.

Still another objective is to optimize the inking efficiency of conventional zoned or keyed lithographic printing presses by eliminating dampening water interference with inking.

Another objective is to minimize dampener-related operating and quality problems in the practice of lithographic printing.

A further objective of this invention is to eliminate need for organic additives to the aqueous dampening water solution, such as isopropyl alcohol or intended substitutes.

Additionally, it is an objective of this invention to provide dampening means whereby the applicable operating range of computerized inking systems may be more accurately extended to virtually any practical lithographic printing condition.

Examples of this disclosure's novel technology will be presented utilizing extant press system configurations, modified according to the principles of this invention insofar as the dampening process of the press system is concerned.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structures. The scope of the invention is defined in the claims appended hereto.

Figure 2:
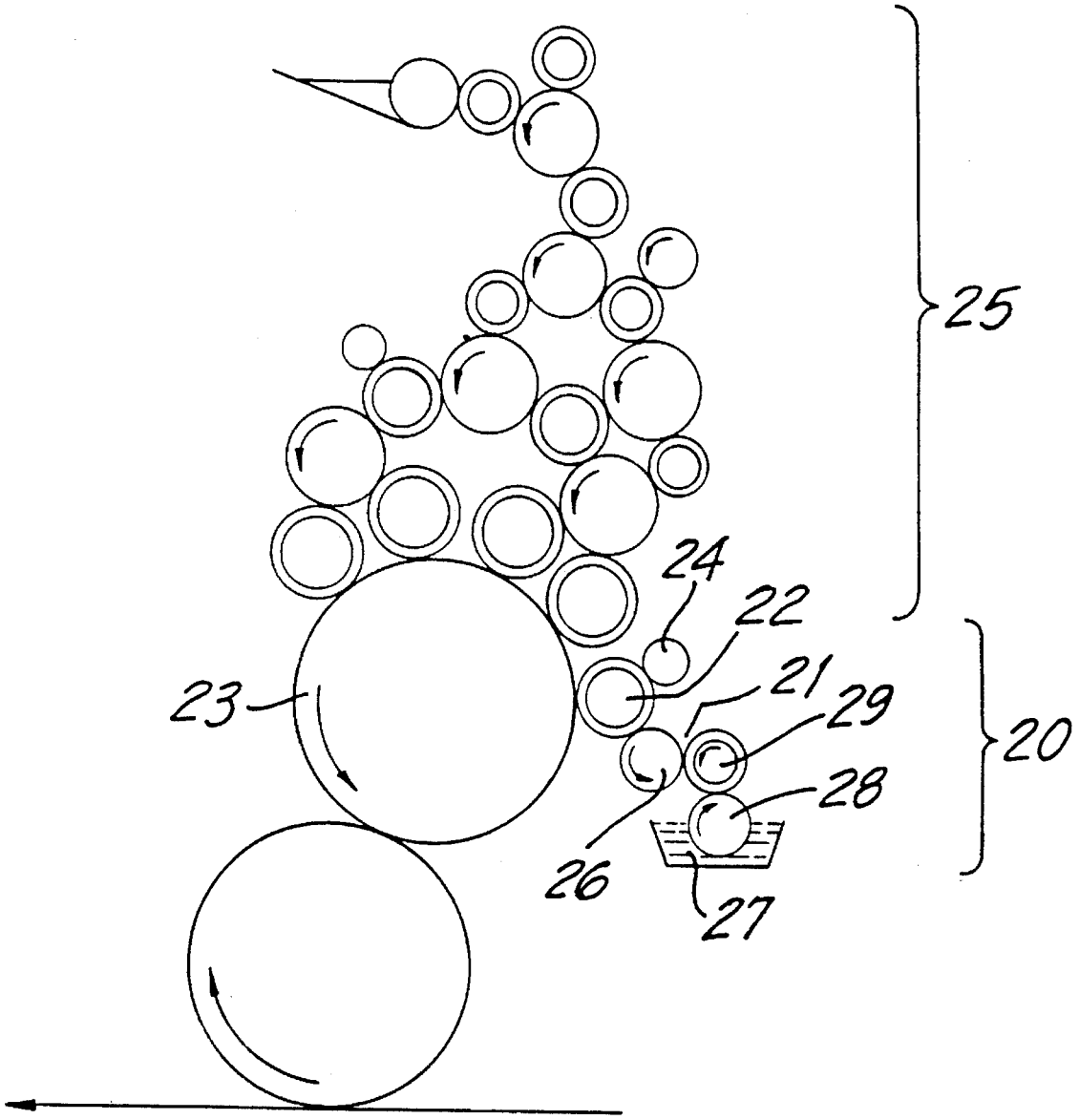
PRIOR ART FIG. 2
FIG. 2 is a roller diagram of another prior art lithographic press.
Figure 5:
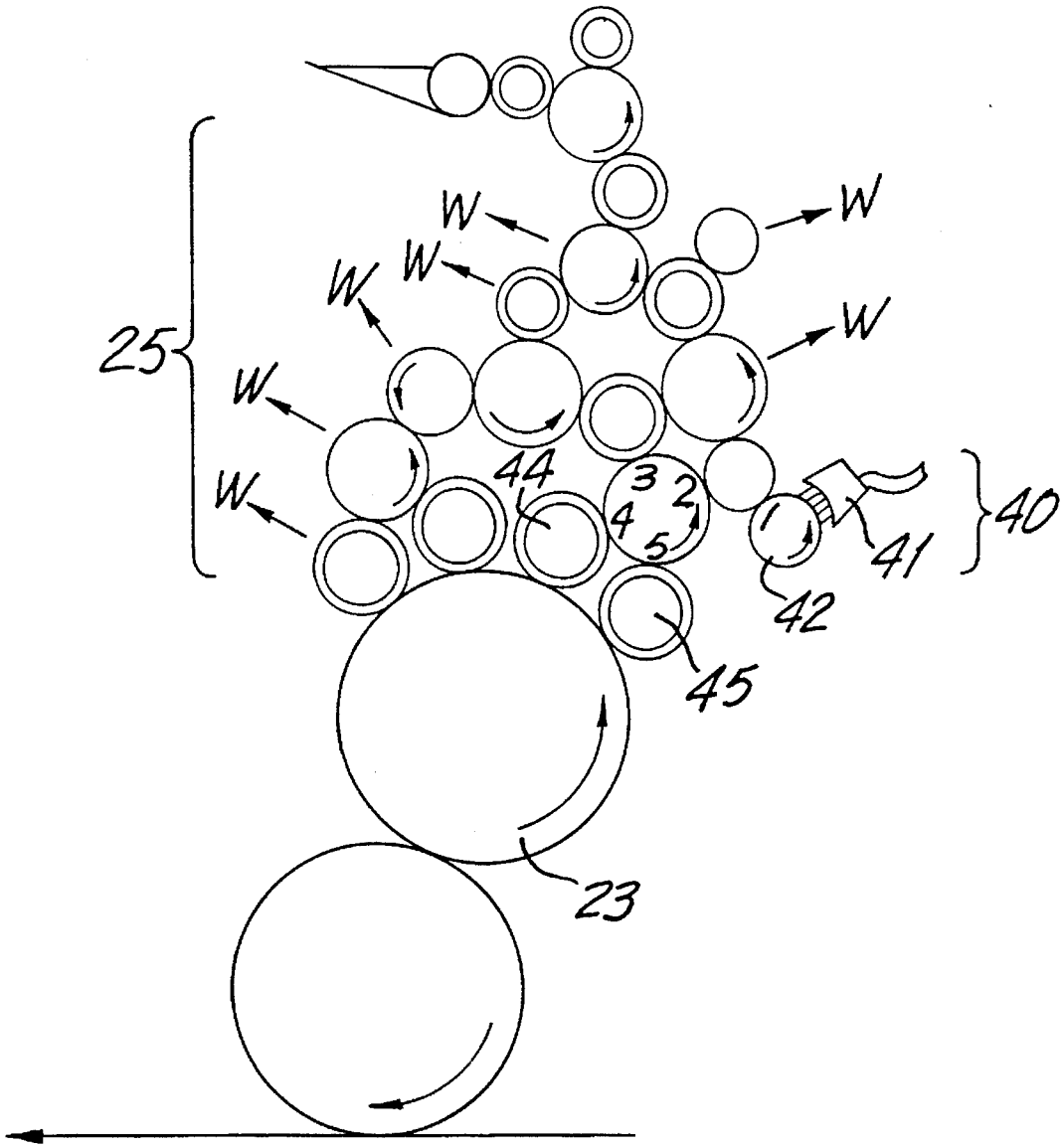
FIG. 5 is a roller diagram of the FIG. 2 lithographic press advantageously modified to incorporate the present invention.

FIG. 5 schematically depicts the Komori Lithrone Press of FIG. 2 fitted with one of the allowable dampening means 40 selected according to the criteria set forth in the practice of this invention. In this variation, the original dampening system is removed and an unconnected water input device 41 sprays dampening water uniformly across a gap onto added oleophilic and hydrophobic dampening water receiving roller 42 or into the vicinity of the nip formed by roller 42 and existing inking roller 43, both of which carry ink films on their surfaces during operation. As indicated by numerals 1 through 5 on the FIG. 5 diagram, there exist at least four nips formed by ink receptive rollers between the dampening water receiving roller 42 and the nearest of the four inking form rollers 44 and 45. The already finely divided droplets of dampening water impinging on the ink film of receiving roller 42 are partially mulled into the ink as further finely divided and smaller droplets by the action at nip 1 between rollers 42 and 43 forming a water-in-ink admixture to a sufficient extent that little or no liquid water film survive on roller 43. The admixture water particles are further worked and broken into yet smaller particles or clusters as the admixture progresses by way of the inking rollers through for instance nips 2, 3, 4 and 5. As the admixture reaches each of these subsequent nips and the plate, the dampening water clusters become sufficiently subdivided to readily enter and remain predominantly within the increasingly thinner admixture ink films located thereon in this downstream ink conveyance direction. Subsequent normal nip pressure contact applied to the admixture on form rollers 44 and 45 at their nips with the plate allows transfer of admixture as predominantly ink to the image areas of the plate and of water as clusters to the plate non-image areas as lithographically required and previously explained herein. At the same time, a portion of the roller 42 input dampening water is conveyed by admixture formation and transfer to all of the contiguous rollers of the inking train of rollers and thereby to all of the inking train evaporative water loss paths, such as those indicated by the 'w' designations in FIG. 5. All of these loss paths become filled relative to water content sequentially before or at least simultaneously with conveyance of the water amount required by the plate water loss paths. Accordingly, not only will the amount of water being transferred to each of the four inking form rollers correspond closely to the minimal amount required to maintain full the natural water vapor loss paths associated with the inking train of rollers, the form rollers, the plate, blanket and the substrate being printed, but also the natural lithographic equilibrium will be obtained and maintained. The total required input water will be readily assimilated by the thick film on inking roller 43 and distributed similarly to all of the ink films on the contiguous inking rollers. No interfering free water film appears anywhere in the press system except as lithographically required in the printing plate non-image areas. As a direct result, all four ink form rollers will be able to deliver the calculated quantity of ink and dampening water to the plate that is expected as if dampening water was not a required second fluid.

Figure 6:
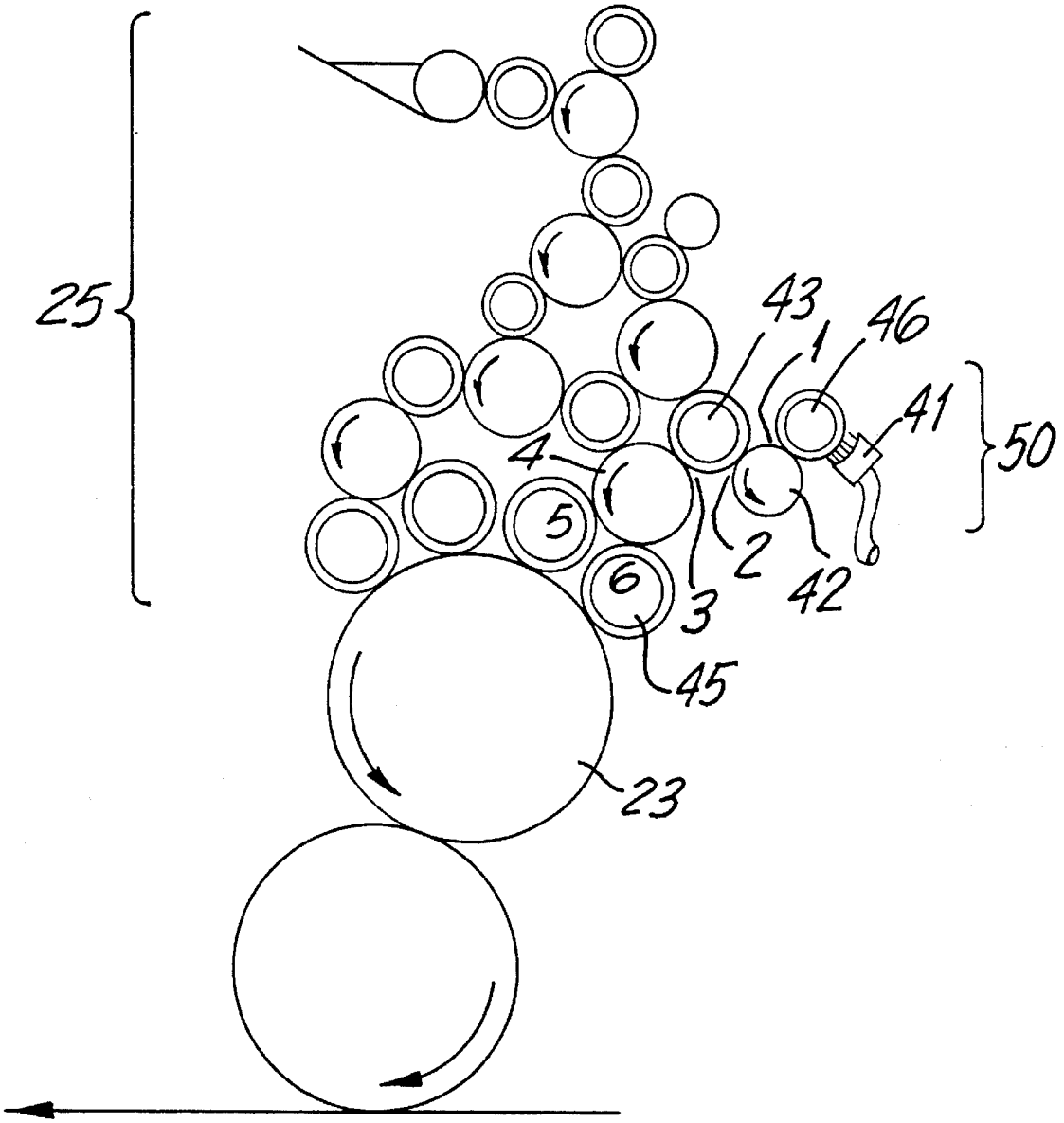
FIG. 6 is a roller diagram generally similar to FIG. 5 but showing an alternative embodiment of the present invention.

A somewhat more efficient dampening water input selection using the same press inking configuration as FIG. 5 is illustrated in FIG. 6. In this variation 50, two oleophilic and hydrophobic rollers 42 and 46 are added as a rider pair on existing inking roller 43. This enables having at least five sequential admixture-conveying roller nips in the water's path to the rotationally nearest inking form rollers on its way to the plate, all other features and advantages being similar to those described for FIG. 5.

Figure 7:
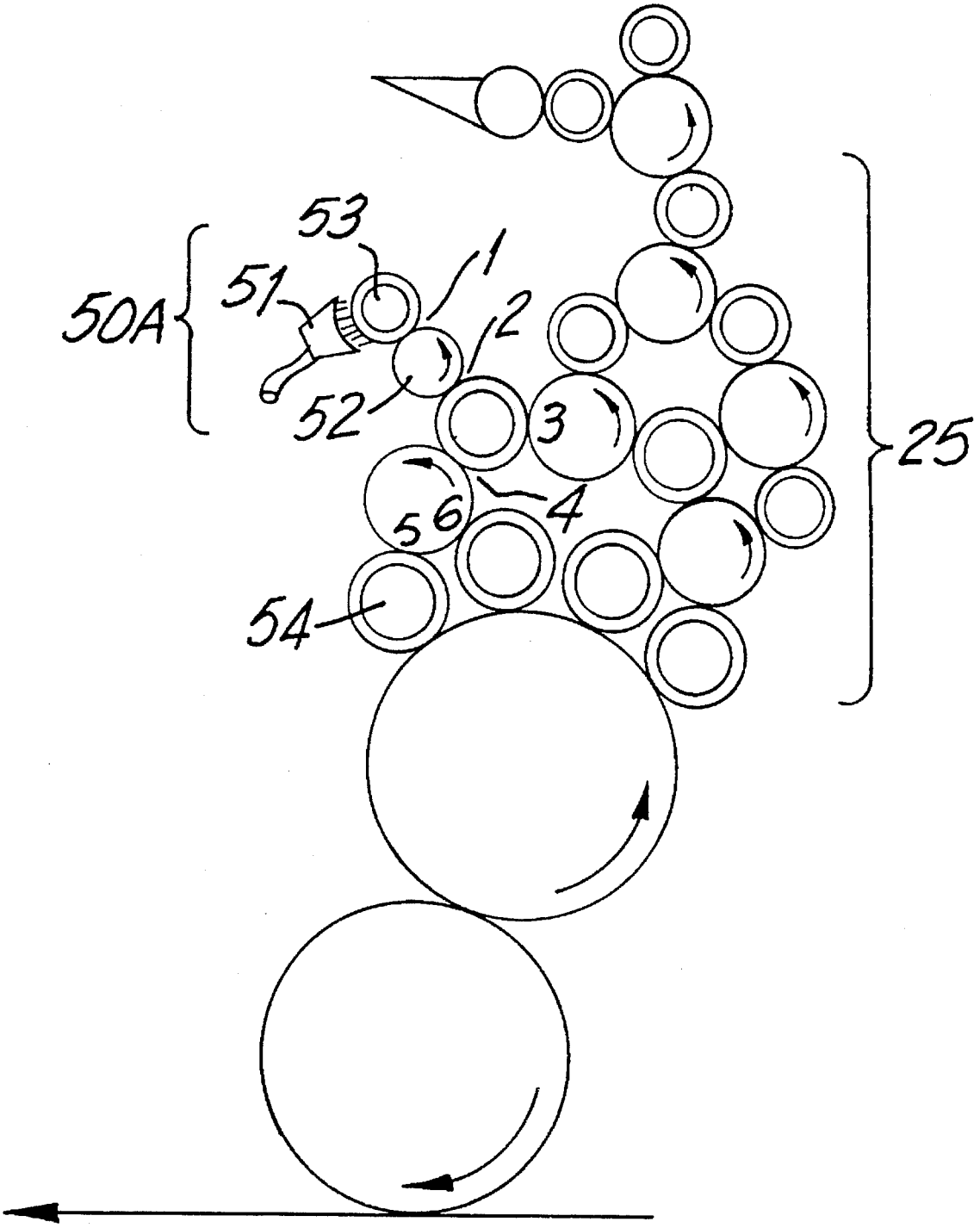
FIG. 7 is a roller diagram generally similar to FIGS. 4 and 5, but showing a further embodiment of the present invention.

To further illustrate the versatility of my invention, an equally efficient location for dampening water input which meets the Criteria already presented is shown in FIG. 7 utilizing the same press inking configuration as in FIGS. 5 and 6. In this variation two oleophilic and hydrophobic dampening rollers 52 and 53 and the detached water spray input means 51 make up the add-on dampening water input components 50A to assure having more than four admixture-active roller nips between the water input 53 and the nearest but rotationally last inking form roller 54. As previously noted herein, rotationally last prior art input of dampening water is generally a complete failure.

Figure 1:
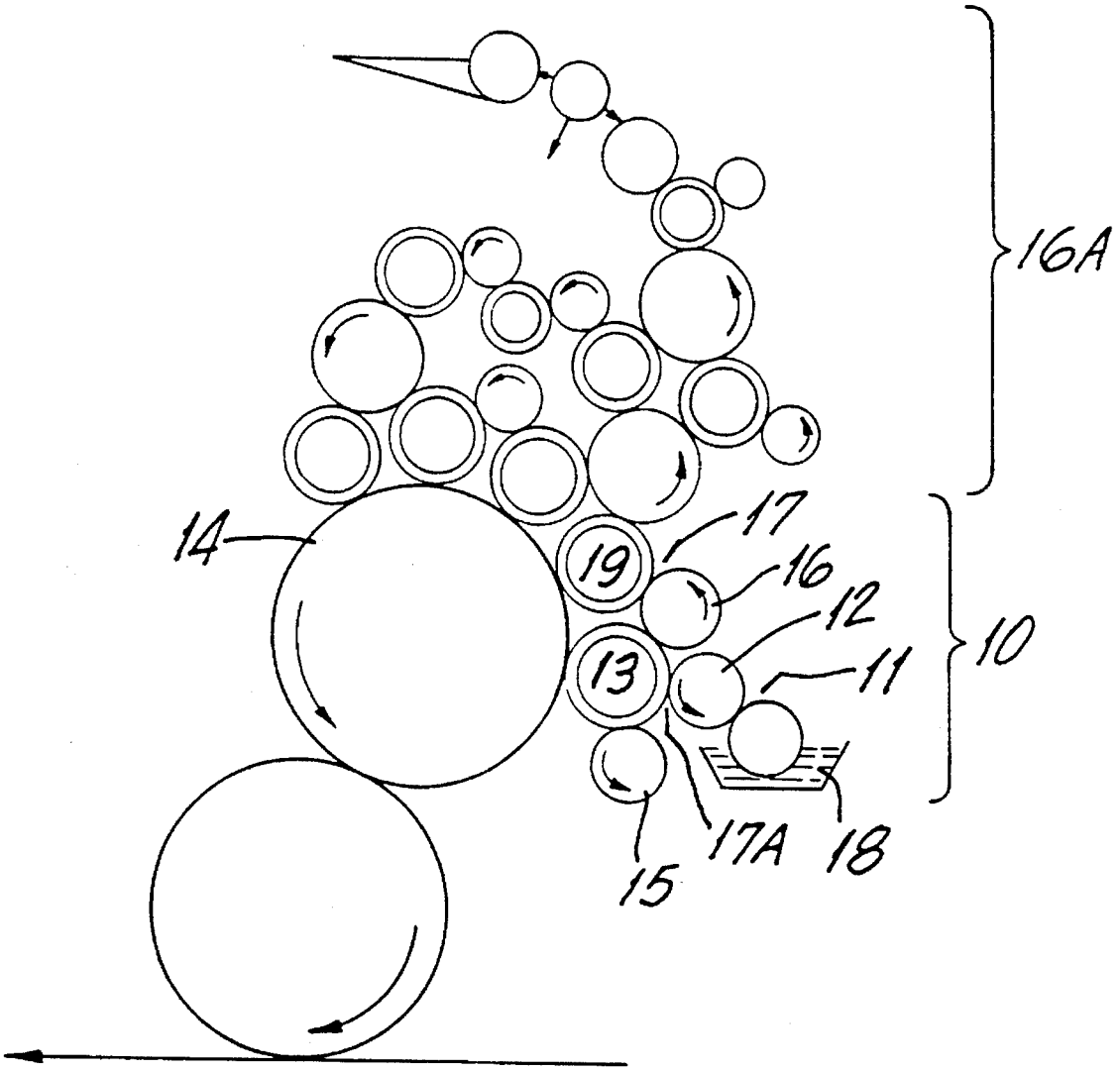
PRIOR ART FIG. 1
FIG. 1 is a roller diagram of a typical prior art lithographic press.
Figure 8:
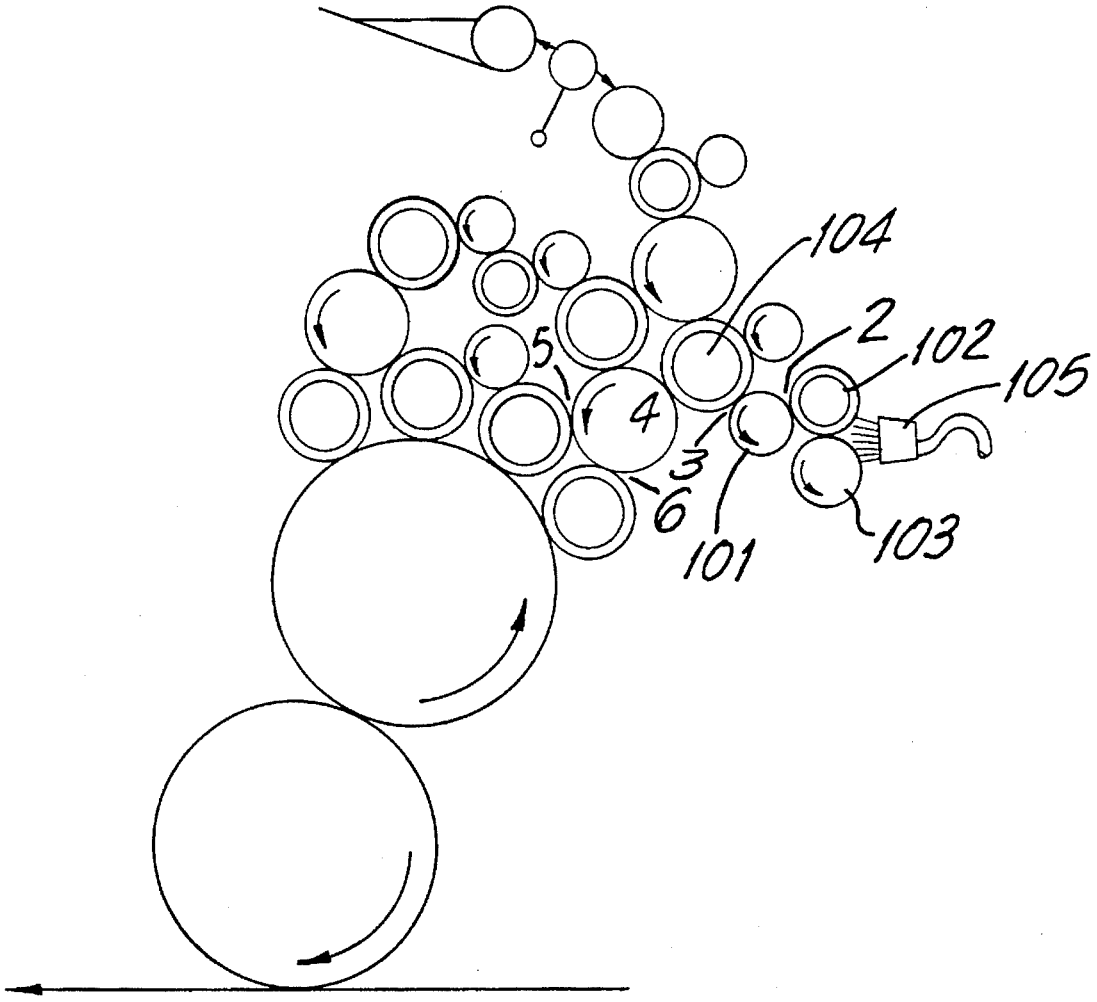
FIG. 8 is a roller diagram of the lithographic press of FIG. 1 altered to incorporate the present invention.
Figure 9:
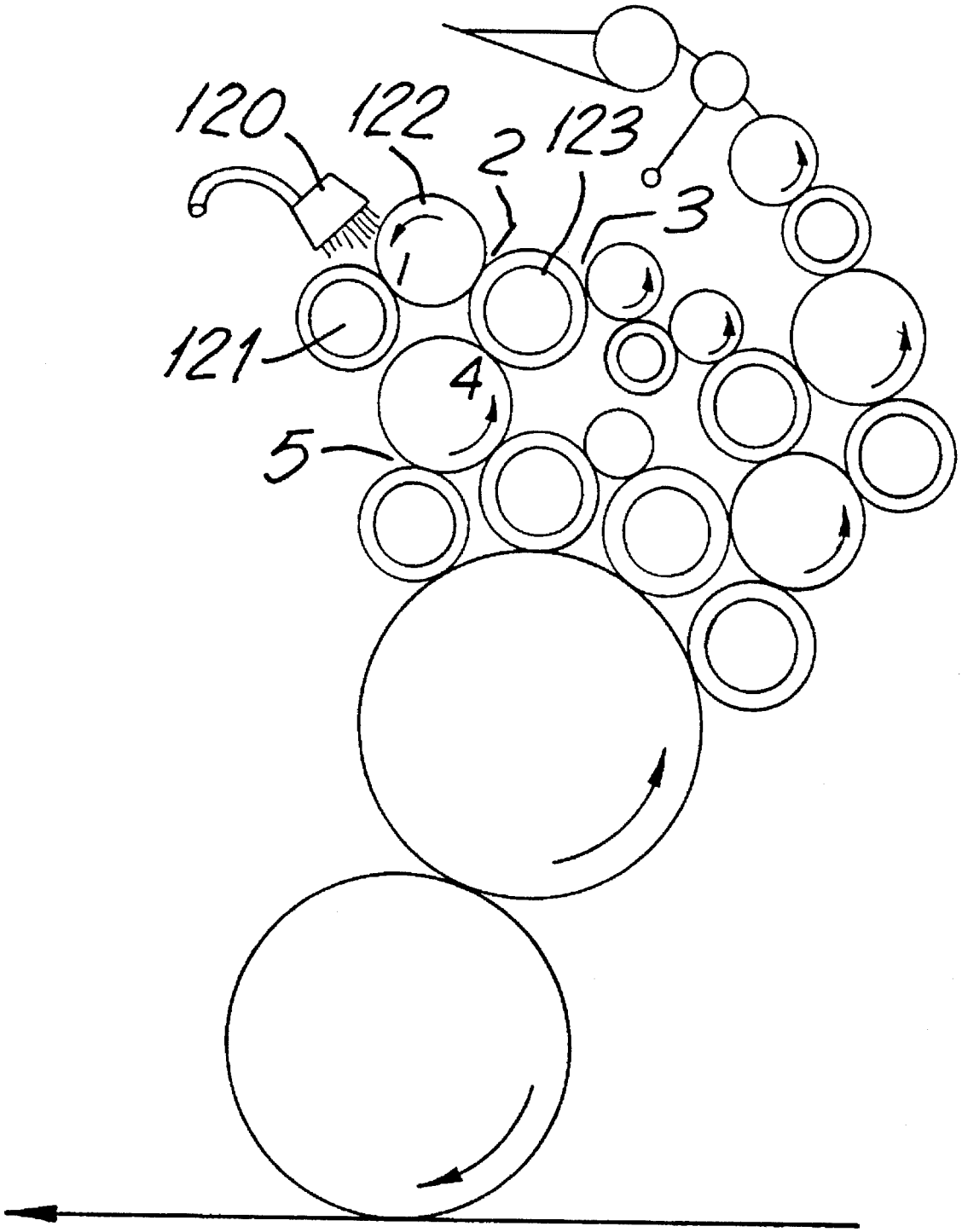
FIG. 9 is a view similar to FIG. 7, but showing an alternative embodiment of the present invention incorporated thereinto.

Another adaptation of these dampening principles can be used to affix ink-carrying dampening water input rollers to the Heidelberg press of FIG. 1, as depicted in FIG. 8 with no change to the configuration of the press. In this case the dampening form roller 13, along with the other rollers of the original dampening input system 10 of FIG. 1, are replaced with oleophilic and hydrophobic rollers 101, 102 and 103 of FIG. 8 with dampening water conveyance roller 101 operating in fluid transfer contact with press inking roller 104 selected so that input dampening water is conveyed to all of the inking rollers as it progress downstream as an admixture in the ink towards the form rollers in contact with the printing plate. Detached dampening water input system 105 sprays the dampening water onto dampening water receiving roller 103 or into the nip formed by rollers 103 and 102. With this modified dampening water input means there again exist at least four admixture-carrying roller nips between the dampening water input roller 103 and any of the inking form rollers. Other suitable locations can readily be determined using the principles and examples provided herein as, for instance, in FIG. 9 in which spray or droplet dampening water input means 120 supplies dampening water to the nip formed by ink receptive oleophilic and hydrophobic dampening water receiving roller 121 and transfer roller 122 to thereby convey fully or partially mulled and admixed dampening water droplets to the downstream conveying inking film carried on inking roller 123 of the inking train of rollers to thereby fulfill all of the criteria for water-film-free dampening water input to the plate, despite the rotationally water-last location of the dampening water input means.

Figure 10:
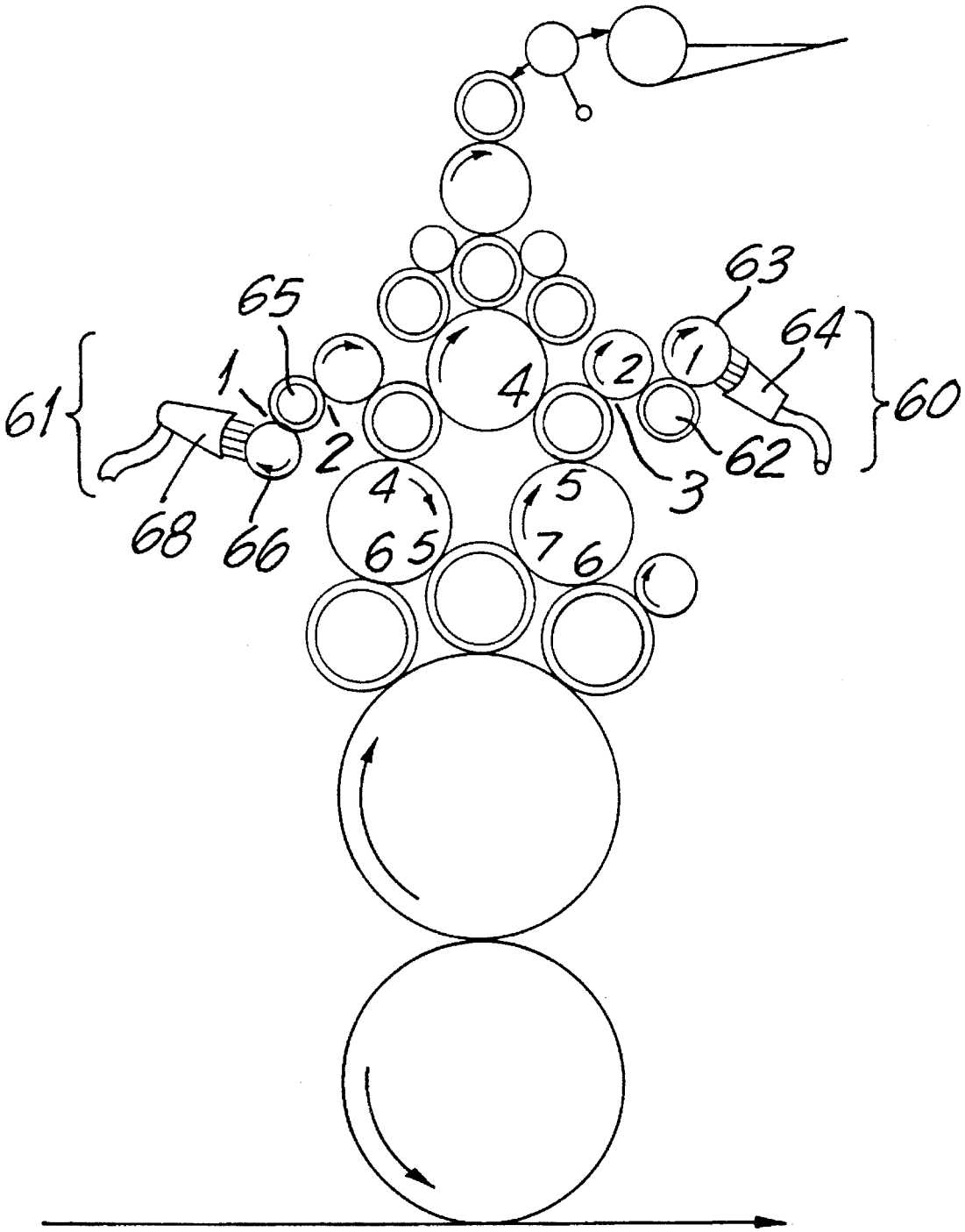
FIG. 10 is a roller diagram of another typical prior art lithographic press modified to incorporate the present invention.

Yet another example of practicing the present invention is illustrated in FIG. 10, which shows a three-ink-form roller printing press configuration marketed by Solna Web International under the trademark SOLNA 224 with its original dampening system removed. Instead, two dampener configurations 60 and 61, according to this invention, are shown together with the press' inking train of rollers in FIG. 10. Either of these alternatives could be used alone with this press configuration. It should be recognized that both dampener systems 60 and 61 could be employed at the same time with significant operational advantages. Dampener components 60 consist of two added oleophilic and hydrophobic rollers 62 and 63 and detached water input system 64. System 61 uses two oleophilic and hydrophobic add-on rollers 65 and 66 together with detached water input device 68. Both devices comply with the four criteria stated previously herein and previously described in detail.

Figure 11:
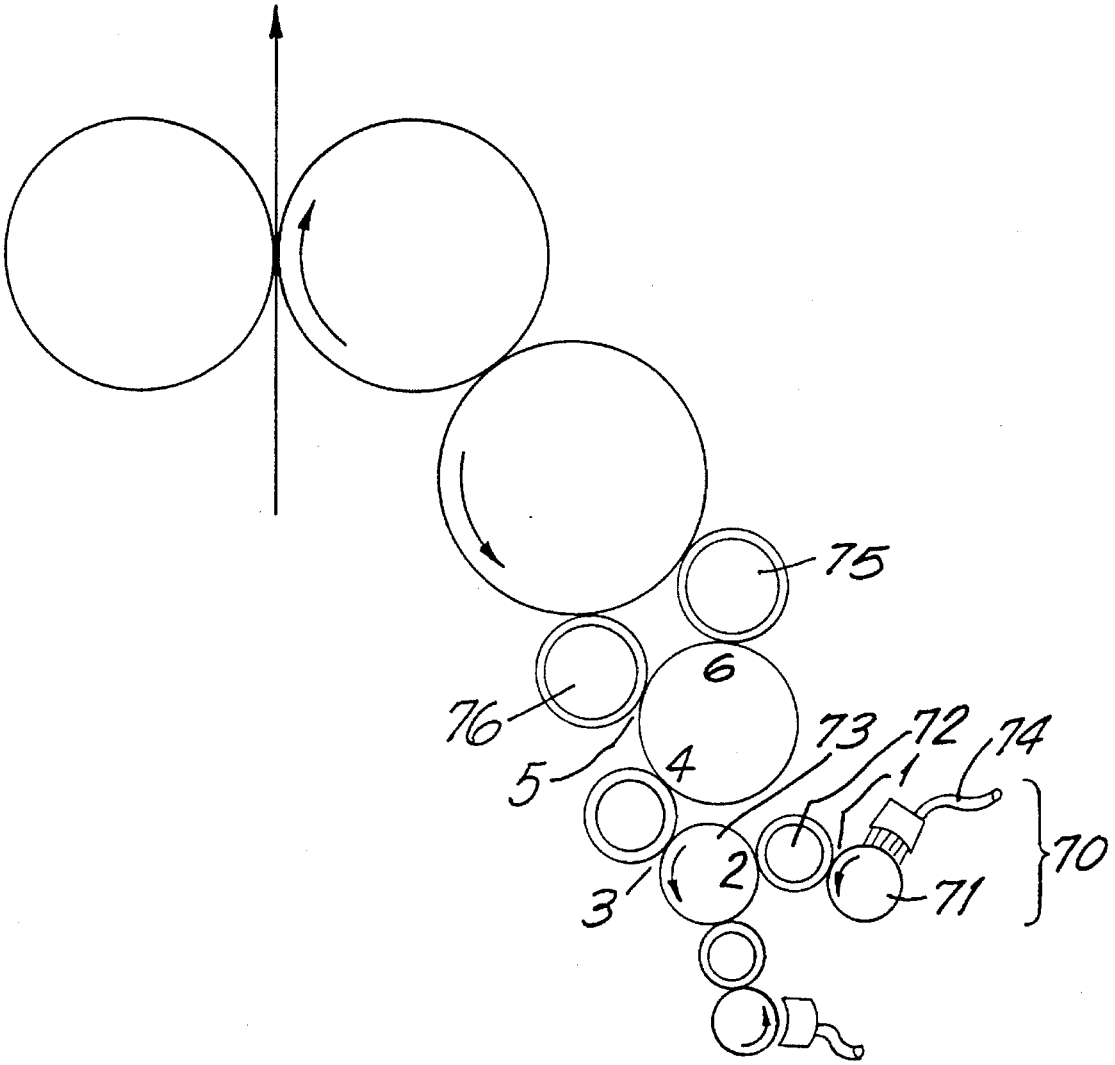
FIG. 11 is a roller diagram of FIG. 4 prior art lithographic press modified to incorporate the present invention.
Figure 12:
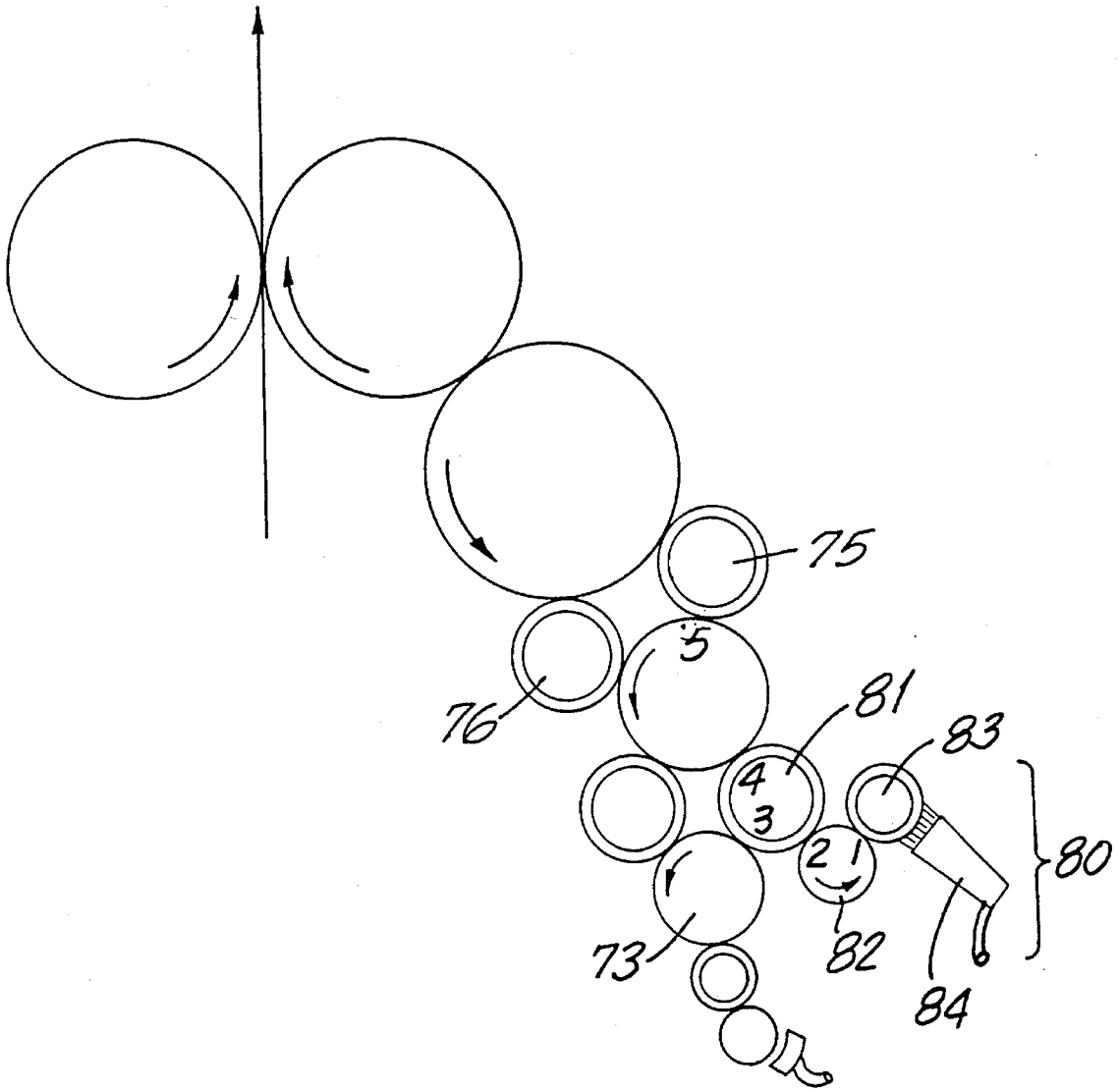
FIG. 12 is a roller diagram similar to FIG. 11, but showing a variation of the present invention incorporated into the lithographic press of FIG. 4.

An example of a more or less conventional web lithographic newspaper press generally similar to those marketed by Mitsubishi Kubaku Ku of Japan, Rockwell Graphic Systems of USA, and MAN-Roland of Germany is shown with various dampening system alternatives according to this invention in FIGS. 11 and 12. In FIG. 11, oleophilic and hydrophobic rollers 71 and 72 are added in rotational contact with existing ink transfer roller 73. Rollers 71 and 72 plus water input device 74 make up the add-on dampening components 70 of this alternative. In this alternative there are at least four ink admixture covered roller nips between dampening solution receiving roller 71 and inking form rollers 75 and 76, as noted on the drawing.

An improved version of the FIG. 10 alternative is shown in FIG. 12. One additional oleophilic and hydrophobic roller 81 is added to the inking train of rollers system so that multiple water paths to inking form rollers 75 and 76 include at least five roller nips. Water input 80 to inking roller 81 is by means of oleophilic and hydrophobic rollers 82 and 83 and spray means 84.

Figure 3:
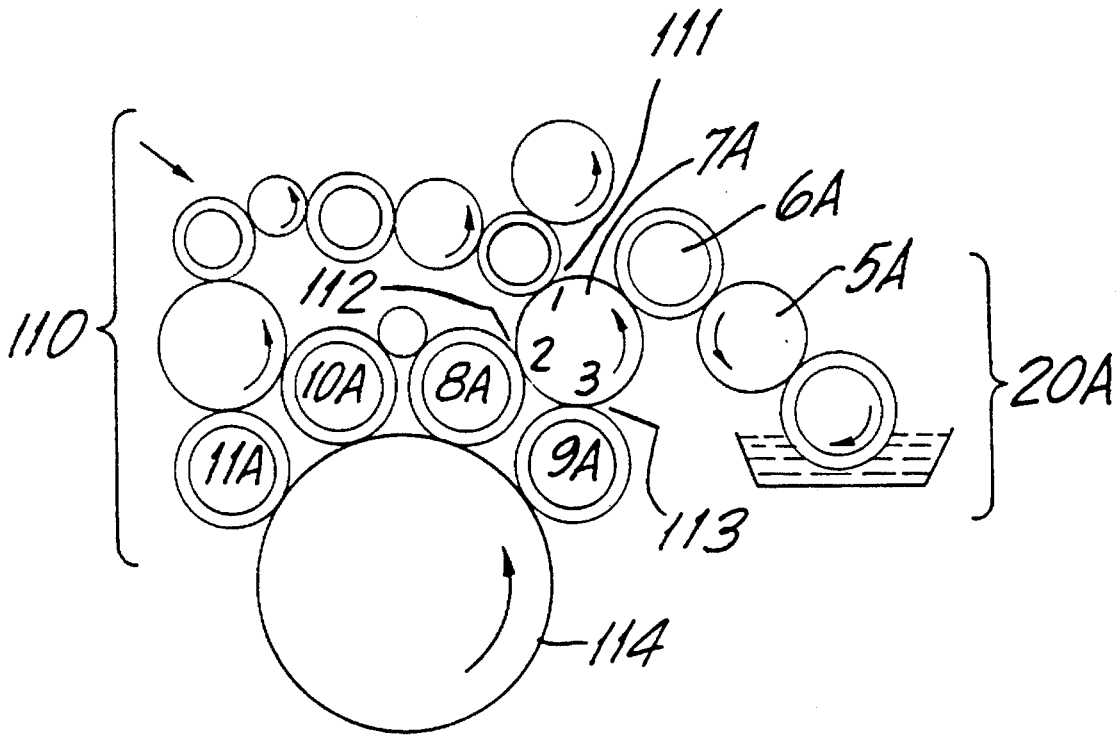
PRIOR ART FIG. 3
FIG. 3 is a roller diagram of a third prior art lithographic press.
Figure 4:
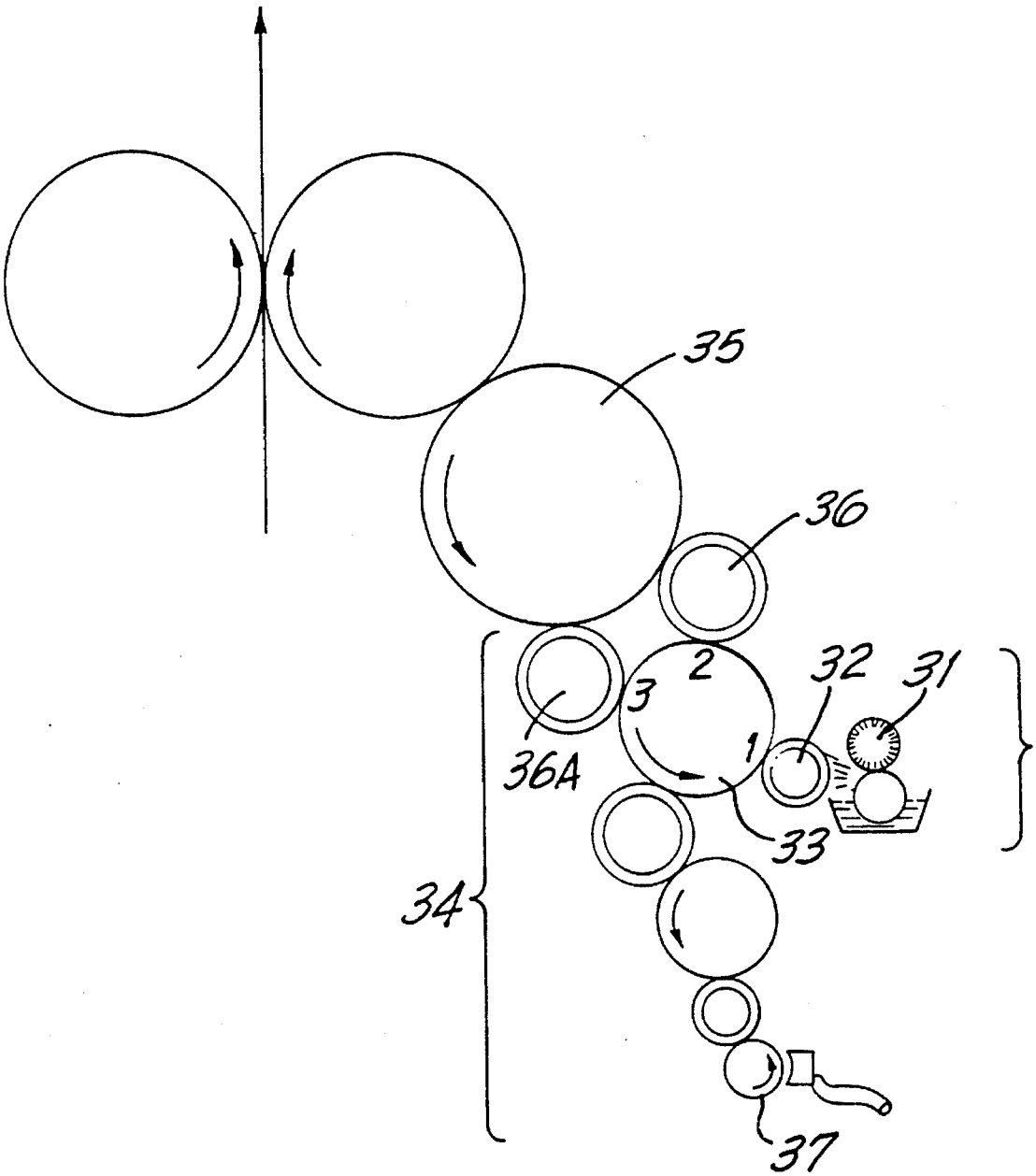
PRIOR ART FIG. 4
FIG. 4 is a roller diagram of a fourth prior art lithographic press.
Figure 13:
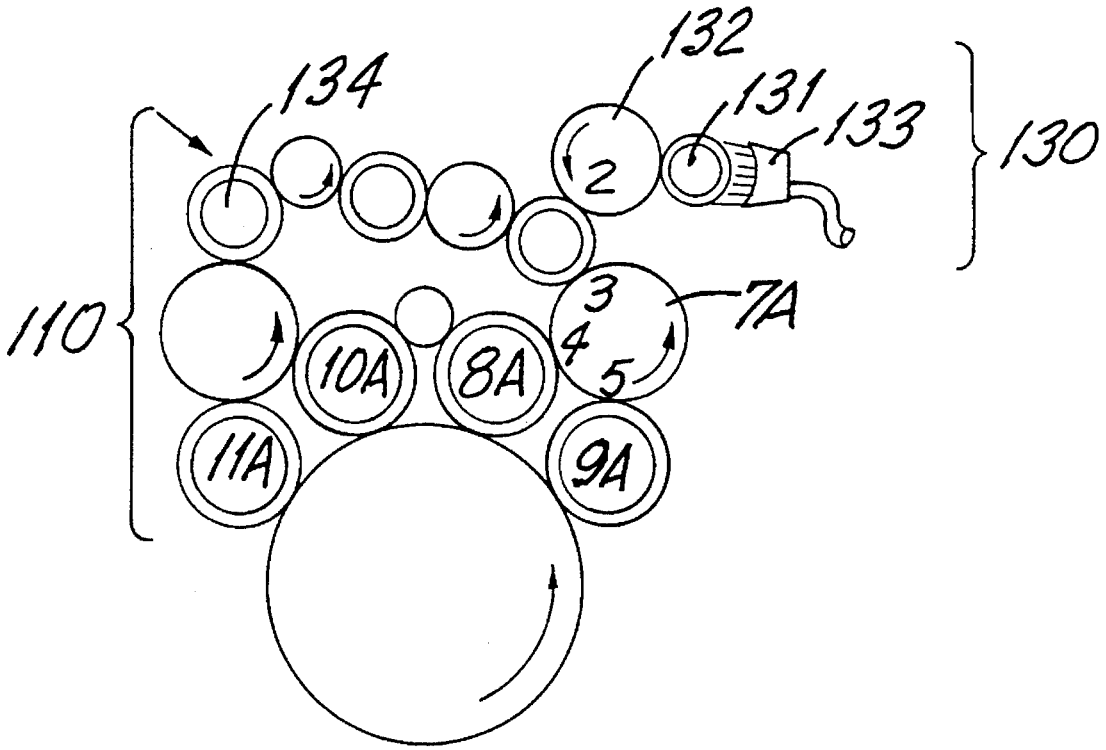
FIG. 13 is a roller diagram of the FIG. 3 diagram modified to illustrate another alternative according to the present invention.

To further illustrate the principles of my invention, in FIG. 13 the FIG. 3 Ghisalberti prior art technology has been modified by elimination of the dampening input system 20A and incorporation of dampening input elements 130 shown in FIG. 13. Press inking roller 132 transfers ink to oleophilic dampening input receiving roller 131 and receives dampening water from roller 131. Dampening water is input to roller 131 by droplet input device 133 here illustrated as a gapped spray device. By this means four or five ink admixture nips are available between roller 131 and inking form rollers 8A and 9A to form and retain a water-in-ink admixture as the ink and water travel in part downstream from the dampening water input. An alternative and preferable location for dampening input system 130 would be at roller 134 instead of at roller 132. With this latter modification both ink and water travel to all of the inking rollers in the downstream inking direction only.

Thus, it is apparent that there has been provided, in accordance with the invention, dampening systems for lithographic presses that fully satisfy the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In a printing press having at least one cylinder carrying thereupon at least one lithographic printing plate and utilizing at least one train of oleophilic and hydrophobic inking rollers to convey ink in a downstream inking direction from an ink input device to the printing plate, said at least one train of oleophilic and hydrophobic inking rollers including a plurality of inking form rollers in fluid transfer contact with said at least one lithographic printing plate, a source of dampening water free of additives, apparatus for conveying said dampening water to said plurality of inking form rollers comprising:

a. an oleophilic and hydrophobic dampening water receiving roller in rotational contact with at least one selected roller of said at least one train of oleophilic and hydrophobic inking rollers and which provides during printing operations the sole source of dampening water input to the printing plate, said oleophilic and hydrophobic dampening water receiving roller together with at least a portion of said at least one train of oleophilic and hydrophobic inking rollers provided during printing operations a plurality of paths to convey dampening water to respective inking form rollers, each dampening water conveyance path of rollers containing at least four sequential nips between said oleophilic and hydrophobic dampening water receiving roller and said respective inking form rollers, and each dampening water conveyance path of rollers being in the downstream inking direction from the selected inking roller; and b. dampening water input means for supplying said dampening water in droplet, cluster, mist or spray form directly to said oleophilic and hydrophobic dampening water receiving roller.

2. In a printing press having at least one cylinder carrying thereupon at least one lithographic printing plate, a plurality of inking form rollers in contact with said lithographic printing plate, an initial dampening water input means associated therewith, and a source of dampening water free of additives apparatus for conveying said dampening water from said initial dampening water input means to said inking form rollers and thence to said lithographic printing plate comprising:

a. an oleophilic and hydrophobic dampening water input receiving roller located across a gap from said initial dampening water input means for directly receiving said dampening water from across said gap;

b. a source of ink; and c. a train of oleophilic and hydrophobic inking rollers which receives and conveys ink in a downstream direction from said source of ink along a plurality of continuous paths formed by said inking rollers to said inking form rollers, a selected roller of said train of oleophilic and hydrophobic inking rollers being in rotational contact with said dampening water input receiving roller which receives said dampening water therefrom and conveys simultaneously through said oleophilic and hydrophobic train of inking rollers said ink and said dampening water along respective portions of said continuous paths formed by said train of oleophilic and hydrophobic inking rollers located downstream of the selected inking roller, the portions of the continuous paths of said oleophilic and hydrophobic inking rollers downstream of the selected inking roller containing at least four sequential nips between said dampening water input receiving roller and each of said inking form rollers.

3. A lithographic printing press comprising:

a a source of ink and a source of dampening water free of additives b. a train of inking rollers having a plurality of downstream ends and an upstream end that receives ink from said source, said train of inking rollers conveying said ink from said source in a downstream inking direction to the respective downstream ends;

c. a plurality of inking form rollers in rotational contact with the respective downstream ends of said train of inking rollers;

d. a printing plate in rotational contact with said inking form rollers;

e. a train of oleophilic and hydrophobic dampening water conveyance rollers having a downstream end in rotational contact with a selected roller of said train of inking rollers and an upstream end said downstream end of said train of dampening water conveyance rollers cooperating with portions of said train of inking rollers and providing respective continuous paths of rollers from the downstream end of the dampening water conveyance train of rollers to each downstream end of the train of inking rollers, and there being at least four sequential roller nips along each of the continuous paths between the downstream end of the dampening water conveyance train of rollers and each of the inking form rollers; and f. means for supplying said dampening water from a supply thereof to the upstream end of said train of dampening water conveyance rollers and conveying said dampening the water by the train of dampening water conveyance rollers to said selected roller of said train of inking rollers, and conveying said dampening water and said ink together from said selected roller of said train of inking rollers along said continuous paths to said inking form rollers and thence to said printing plate with said dampening water and said ink being mulled together within said at least four sequential roller nips in each of the continuous paths between said selected roller of the train of inking rollers and the respective inking form rollers.

4. The lithographic printing press of claim 3 wherein the continuous paths of rollers from the downstream end of the train of dampening water conveyance rollers to the respective inking form rollers convey said dampening water only in the downstream inking direction of said lithographic printing press.

5. The lithographic printing press of claim 3 wherein the train of dampening water conveyance rollers includes an oleophilic and hydrophobic roller in rotational contact with the selected roller of the train of inking rollers, said oleophilic and hydrophobic roller receiving said dampening water from the means for supplying said dampening water of said lithographic printing press.

6. In a lithographic printing press having a printing plate, inking form rollers in rotational and liquid transfer contact with said printing plate, a train of oleophilic and hydrophobic inking rollers which convey ink from a source thereof along ink distribution paths of said inking rollers to said inking form rollers, and a source of dampening water free of additives;

means for conveying said dampening water from the source thereof to said inking form rollers along dampening water distribution paths which have respective portions thereof in common with respective selected portions of said ink distribution paths, each of said respective portions of said ink distribution paths having at least four sequential nips there along, said means for conveying said dampening water from the source of dampening water to the inking form rollers comprises:

an oleophilic and hydrophobic dampening water receiving roller which is in rotational and fluid transfer contact with a selected roller of the train of oleophilic and hydrophobic inking rollers, said oleophilic and hydrophobic dampening water receiving roller cooperating with said selected roller of said train of oleophilic and hydrophobic inking rollers forming one of the nips of each of said respective selected portions of the inking distribution paths which are in common with the respective portions of the dampening water distribution paths, and a train of oleophilic and hydrophobic dampening water input rollers comprising a train of dampening water conveyance rollers which is in rolling contact with said dampening water receiving roller and with a selected roller of the inking train of rollers such that said train of dampening water conveyance rollers becomes ink covered, said train of dampening water conveyance rollers cooperating with said selected roller of said inking train of rollers to convey said dampening water to the respective portions of the dampening water distribution paths that are in common with the respective selected portions of the ink distribution paths, and said dampening water conveyance rollers cooperating with the selected inking roller to form one or more of the nips of each of the respective selected portions of the inking distribution paths which are in common with the respective portions of the dampening water distribution paths.

* * * * *